United States Patent [19]

Nation et al.

[11] Patent Number: 4,633,766

[45] Date of Patent: Jan. 6, 1987

[54] ADAPTER FOR JOINING HEATER AND AIR CONDITIONING ELEMENTS

[75] Inventors: James H. Nation; Donald C. Tomlinson, both of Dallas, Tex.

[73] Assignee: First Co., Dallas, Tex.

[21] Appl. No.: 742,471

[22] Filed: Jun. 7, 1985

[51] Int. Cl.[4] ..... F24F 13/02

[52] U.S. Cl. ..... 98/1; 98/39.1; 285/4; 285/414

[58] Field of Search ..... 98/1, 39.1; 285/3, 4, 285/424, 414

[56] References Cited

U.S. PATENT DOCUMENTS

| | | | |
|---|---|---|---|
| 565,499 | 8/1896 | Pattison | 285/424 |
| 1,159,422 | 11/1915 | Scannell . | |
| 1,374,866 | 4/1921 | Spencer . | |
| 1,461,438 | 7/1923 | Buller . | |
| 1,462,482 | 7/1923 | Buller . | |
| 1,818,858 | 8/1931 | McAlees . | |
| 1,881,679 | 10/1932 | Klomparens . | |
| 2,791,448 | 5/1957 | Jackes et al. . | |
| 2,799,518 | 7/1957 | Anderson et al. | 285/424 |
| 3,347,569 | 10/1967 | Lindgren | 285/424 |
| 3,687,168 | 8/1972 | Sherman et al. | 285/424 |
| 3,800,846 | 4/1974 | Kurz . | |
| 3,866,950 | 2/1975 | Skoch et al. . | |
| 4,304,427 | 12/1981 | McCabe . | |

*Primary Examiner*—Larry I. Schwartz

*Attorney, Agent, or Firm*—Richards, Harris, Medlock & Andrews

[57] ABSTRACT

An adapter (10) as disclosed which is employed to join a heater (12) and an air conditioning evaporator (14) in an air conditioning system. The adapter (10) is provided with a series of slidable panels (60, 62, 64) which permit the adapter to be sized to fit a particular heater (12) by breaking off selected segments of the panels along a series of frangible connections (74, 84). In a second embodiment, an adapter (100) is provided with end panels (108) and side panels (112) which also include segments that can be broken off from the panels along a series of frangible connection (118). The panels (108, 112) are secured about the edges of the frame (102) of the adapter (100).

15 Claims, 10 Drawing Figures

ADAPTER FOR JOINING HEATER AND AIR CONDITIONING ELEMENTS

TECHNICAL FIELD

This invention relates to the the heating and ventilation industry, and more specifically to a universal adapter for joining a heater and air conditioner evaporator to support the evaporator and provide an air flow passage between the elements.

BACKGROUND OF THE INVENTION

Central air conditioning has become virtually standard throughout the housing industry, as well as in industrial buildings. Over the years, a standard practice has been developed which uses three elements in the central unit. The first element is a fan for forced air circulation. The output of the fan is then passed through a heater containing a heating element, which allows the air to be heated. The third element is an air conditioning evaporator which, in combination with a condensor in a separate location, is capable of cooling the air. The heater and air conditioner evaporator are joined together, with the air plenums of the heater and air conditioning evaporator forming a portion of the output flow path from the fan.

The heating and ventilation industry contains many manufacturers, a large number of whom make only a heater or evaporator. As yet, no industry wide standards have been establish to control the configurations and dimensions of the heater and evaporator units produced by these manufacturers. Therefore, an adapter is often required to join the evaporator to the heater to support the evaporator and also connect the plenums of the two devices. However, because of the wide variation in units available in the industry, literally hundreds of dimensional combinations are possible and this fact has required the adapter to be virtually custom made for a given installation. This results in increased material and labor costs and can result in a poor connection between the units.

Therefore, a need exists for an adapter which may be employed for more than a single combination of a heater and evaporator which eliminates the need for a custom manufacture of the adapter for a particular application.

SUMMARY OF THE INVENTION

In accordance with one aspect of the present invention, an adapter is disclosed for connecting one element in an air conditioning system to another element with the air plenums of the elements connected. The first element defines a support surface and a first lip. The second element defines a second lip. The adapter includes a frame and at least one panel. Structure is provided for mounting the panel on the frame. The panel has at least one disposable segment connected to the remainder of the panel by a frangible connection to permit the panel to be broken along a frangible connection to insure that the adapter is properly sized to fit between the elements.

In accordance with another aspect of the present invention, the adapter includes a frame having first and second end pieces and first and second side pieces. The pieces are secured at their ends to form a generally rectangular frame with the first end piece and side pieces each having a lip for attachment of the adapter to the lip of an air conditioning evaporator. A first slidable side panel having a lip and a flat portion defining an edge is provided. The first side piece and end pieces support the first slidable side panel for sliding motion between a position with the edge proximate the lip of the first side piece to a position with the lip of the first slidable side panel abutting the lip of the first side piece, the flat portion being formed by a series of segments, each separated by a frangible connection so that selected ones of said segments can be broken away from the first slidable side panel along one of the frangible connections to move the edge relative the lip of the first slidable side panel to fit the adapter to a heater. A second slidable side panel is similarly mounted as is a first slidable end panel for adapting the adapter to join a particular heater and air conditioning evaporator.

In accordance with yet another aspect of the present invention, an adapter is provided which includes a rectangular frame for attachment to an evaporator. Two end panels are secured to the form and extend inwardly therefrom. Two side panels overlay the end panels and are also secured to the frame and extend inwardly therefrom. Each of the panels is formed by a plurality of segments, each separated by a frangible connection so that selected segments can be broken off the panels to fit the adapter to the heater.

BRIEF DESCRIPTION OF THE DRAWINGS

A more complete understanding of the invention and its advantages will be apparent from the following Detailed Description when taken in conjunction with the accompanying Drawings in which.

DETAILED DESCRIPTION

Figure 1:
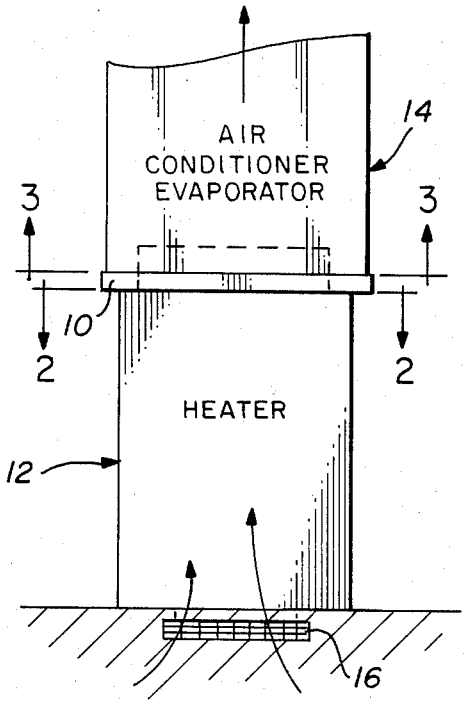
FIG. 1 is an illustrative view of a conventional heating system incorporating a heater and air conditioning evaporator joined by an adapter forming a first embodiment of the present invention.

Referring now to the drawings, wherein like reference characters designate like or corresponding parts throughout several views, and in particular to FIGS. 1–7, an adapter 10 is illustrated. Adapter 10 is designed to join a heater 12 to an air conditioner evaporator 14 in an air conditioning system.

FIG. 1 illustrates a common configuration for a system such as might be found in the closet of a residential home. A circulation fan is provided in the heater 12 which draws air through a duct 16 and moves it past heating coils within heater 12. The air can be heated by gas, electricity or any other suitable energy source. The air conditioning evaporator 14 sits on top and is supported by the heater 12 through the adapter 10. The adapter 10 not only joins the heater 12 and evaporator 14 structurally, but also provides a connection between the air plenums of the heater and evaporator so that the air circulated by the fan in the heater 12 passes over the evaporator coils in evaporator 14. Conventionally, the evaporator coils within evaporator 14 are connected to a compressor in a remote location to cool the circulated air. While heater 12 and evaporator 14 are shown stacked vertically for mounting in a closet, etc., the heater 12 and evaporator 14 can as readily be joined by adapter 10 in a horizontal side-by-side position for use in an attic, etc.

As noted previously, one significant problem in assembling an air conditioning system for both residential and commercial applications is mating the heater and air conditioning units. The adapter 10 provides great flexibility in adapting a particular air conditioning evaporator 14 to a range of dimensions for the heater 12. The adapter 10 is therefore specifically designed to fit a particular evaporator 14. However, it would be equally possible to use an adapter of the present design to adapt a particular dimensioned heater to a wide variety of evaporator designs.

Figure 2:
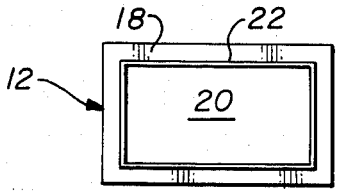
FIG. 2 is a view of the top of the heater taken along line 2—2 in FIG. 1.
Figure 3:
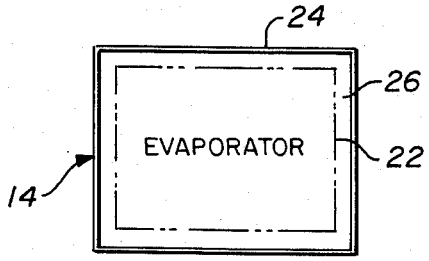
FIG. 3 is a view of the bottom of the air conditioning evaporator taken along line 3—3 in FIG. 1.
Figure 4:
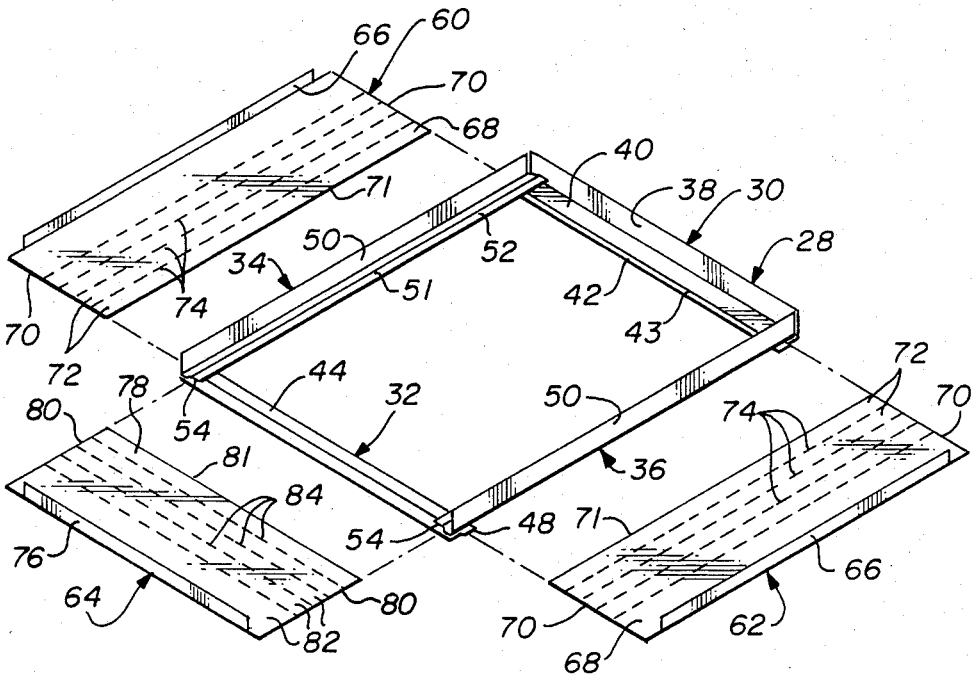
FIG. 4 is an exploded perspective view of the adapter.

As shown in FIG. 2, the top of heater 12 includes a horizontal top surface 18 in a generally annular shape about the air flow opening 20 opening from the plenum within the heater. A vertically extending lip 22 extends upward from the inner edge of the top surface 18. As best seen in FIG. 3, the bottom of the evaporator 14 includes a horizontal bottom lip 24 which forms a generally annular configuration about the air flow inlet 26 opening into the plenums of the evaporator 14.

With reference now to FIGS. 4–7, the particular construction of adapter 10 is illustrated. The adapter 10 includes a frame 28 formed of end pieces 30 and 32 and side pieces 34 and 36. The pieces 30–36 are generally secured together to form a rectangle.

End piece 30 includes a lip 38 and parallel guides 40 and 42, which define a narrow slot 43 therebetween. End piece 32 is formed with a downward step 44 which defines slot 48 facing slot 43 in combination with side pieces 34 and 36. Side pieces 34 and 36 are identical and each include a lip 50 and a guide 52. Where the side pieces 34 and 36 are secured to end piece 32, slots 54 are formed between upward steps 51 in guides 52 and end piece 32.

The adapter 10 further includes a first slidable side panel 60, a second slidable side panel 62 and a slidable end panel 64. The side panels 60 and 62 each have a lip 66 and flat portion 68. The outer edges 70 of the side panels fit in and are supported for sliding motion by slots 43 and 48. The flat portions 68 are formed by a series of segments 72, each separated by a frangible connection 74. Connection 74 can be formed by almost separating the adjacent segments in a punching operation to leave only a thin connection therebetween, much as is done for punch outs found in electric junction boxes and the like, by forming a series of holes through the flat portion along the connection to provide a weakened connection, or any other suitable technique which allows ready breaking of the connection for adjusting the adapter 10 to heater 12, yet which provides a connection strong enough so that the adapter 10 functions properly if the connection does not need to be broken in fitting the adapter 10 to the heater 12.

Each frangible connection 74 is designed to allow one or more segments to be broken off, leaving a clean break line, allowing the distance between interior edge 71 of the panel and lip 66 to be varied. The slidable end panel 64 is of similar design with a lip 76 and flat portion 78 having outer edges 80 for slidable motion in slots 54. The flat portion 78 is formed of segments 82, each separated by a frangible connection 84 and has an interior edge 81.

Figure 5:
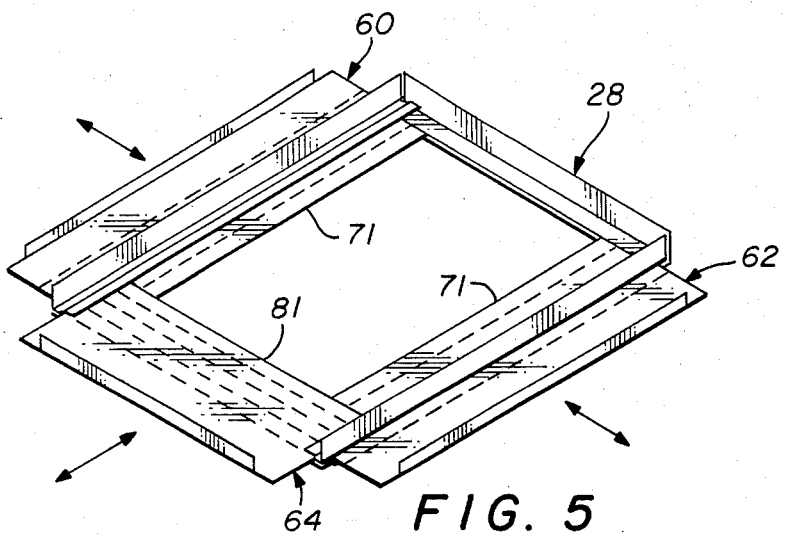
FIG. 5 is a perspective view of the adapter illustrating the motion of the slidable panels.
Figure 6:
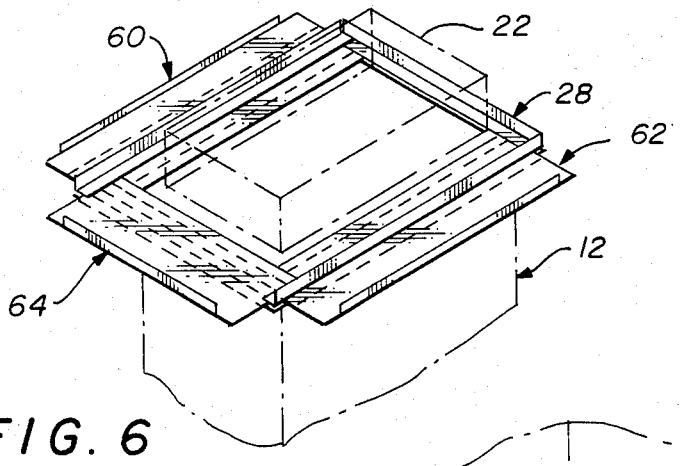
FIG. 6 is a perspective view of the adapter being mounted on the heater.
Figure 7:
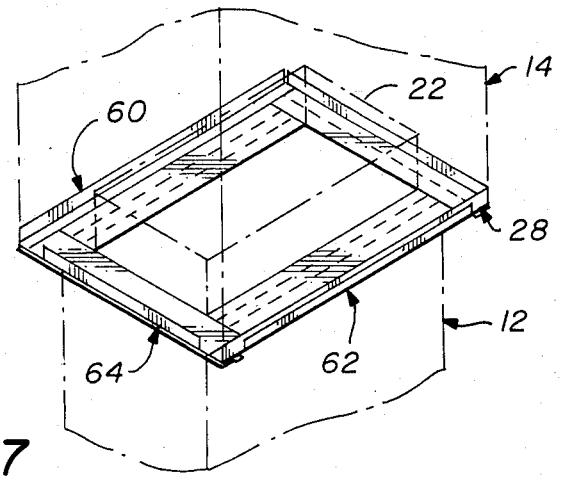
FIG. 7 is a perspective view of the adapter joined between the heater and air conditioning evaporator.

As can best be seen in FIG. 5, the panels 60–64 are freely slidable relative to the frame 28 in the direction of the arrows as illustrated. The lips 38 and 50 of the frame 28 are positioned to receive the bottom of the air conditioning evaporator 14 as seen in FIG. 7 and thus the adapter 10 is designed to fit a particular size evaporator 14. However, the adapter 10 can be adapted as seen in FIGS. 6 and 7 to cooperate with a wide variation of dimensions in heater 12 by breaking off selected ones of the segments 72 and 82 along frangible connections 74 and 84 so that the lips 66 and 76 of the panels abut the frame 28, with the interior edges 71 and 81 surrounding the lip 22 to support the evaporator on the heater and provide a connection between the air plenums in the heater and evaporator.

Figure 8:
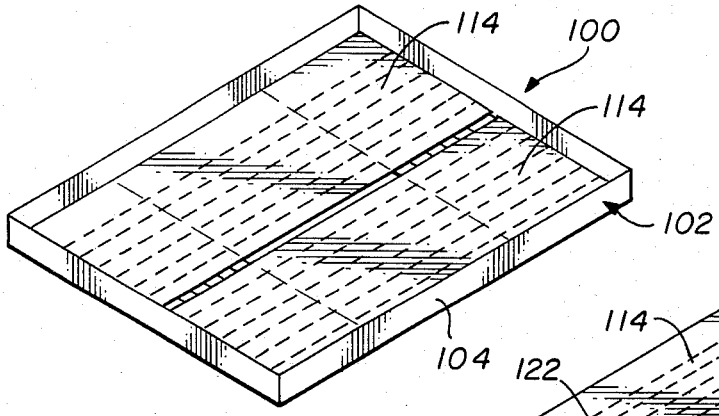
FIG. 8 is a perspective view of a second embodiment of the present invention which incorporates fixed panels.
Figure 9:
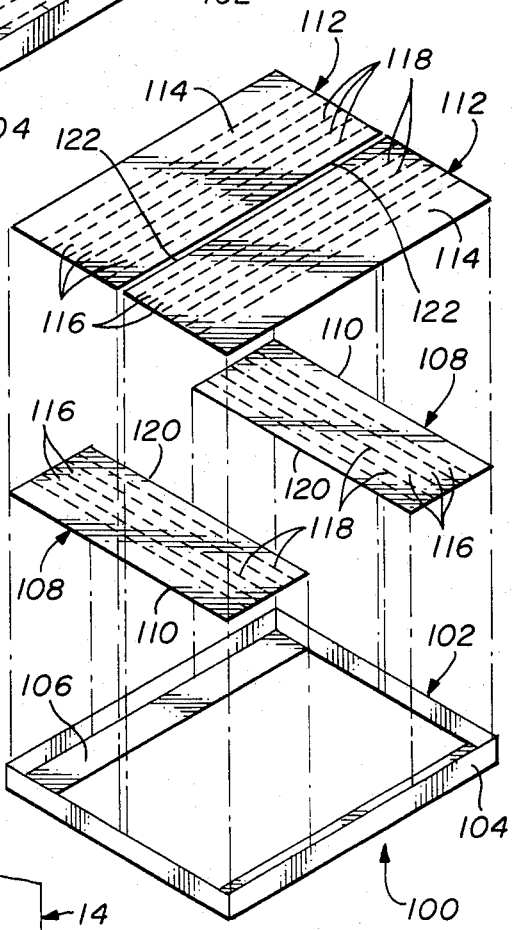
FIG. 9 is an exploded perspective view of the second embodiment of FIG. 8.
Figure 10:
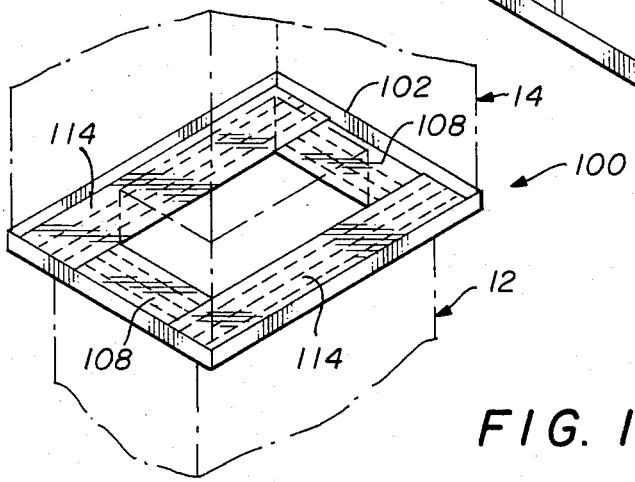
FIG. 10 is a perspective view illustrating the adapter forming the second embodiment joining a heater and air conditioning evaporator.

FIGS. 8–10 illustrate a second embodiment of the present invention defined by an adapter 100. Adapter 100 incorporates the general principles of operation of adapter 10 but does not include slidable panels. As seen, adapter 100 is provided with a rectangular frame 102 having raised lips 104 on all sides and horizontal rim 106 on two opposed sides for mounting to the air conditioning evaporator 14. End panels 108 are secured to the frame 102 along their outer edges 110 and side panels 112 are laid over end panels 108 and are secured to the frame along their outer edges 114. Each of the panels is provided with segments 116, each separated by a frangible connection 118. As can be readily observed in comparison of FIG. 9 and FIG. 10, the inner edges 120 of panels 108 and inner edges 122 of side panels 112 can be moved outwardly to fit the particular heater 12 by breaking off a suitable number of segments off the panels along a suitable frangible connection 118.

The present invention, as embodied by adapters 10 and 100, can be seen to provide an effective and inexpensive solution to the problem of mating devices in a system such as a heater and air conditioning evaporator. While the invention has been described as joining a heater and air conditioning evaporator, the principle of the invention is readily adaptable to the joining of any two elements in an air conditioning system. Furthermore, the adapter can be constructed integrally with either a heater or an evaporator. For example, if the adapter is made integral with an evaporator, frames 28 or 102 can actually be part of the evaporator housing.

Although several embodiments of the present invention have been illustrated in the accompanying drawings and described in the foregoing Detailed Description, it will be understood that the invention is not limited to the embodiments disclosed, but is capable of numerous rearrangements, modifications and substitutions of parts and elements without departing from the scope and spirit of the invention.

We claim:

1. An adapter for joining facing ends of first and second elements in an air conditioning system for air flow therebetween, the end of the second element having a smaller cross section than the end of the first element, the second element defining a support surface at its end and a lip extending from the support surface about the inner edge of the support surface, comprising:

a frame for attachment about the end of the first element;

at least one panel having a plurality of side by side segments, each segment separated from the adjacent segment by a frangible connection to permit selected segments to be broken off the panel; and means for attaching the panel within said frame to reduce the size of the opening through the frame and block off a portion of the cross section of the first element at its end, selected segments being broken off the panel to increase the size of the opening so that the adapter rests on the support surface of the second element with the lip extending through the opening in the frame thereof.

2. The adapter of claim 1 wherein said means for attaching mounts the panel on the frame for sliding motion.

3. The adapter of claim 1 wherein said frame is rectangular and the adapter includes two side panels and two end panels.

4. The adapter of claim 2 wherein said frame is rectangular and the adapter includes two side panels and an end panel, said means for attaching mounting the panels on the frame for sliding motion.

5. The adapter of claim 1 wherein said frame is integral with the first element.

6. An adapter for connecting a heater to an air conditioner evaporator with the air plenums of the heater and air conditioner evaporator connected, the heater having an end with an opening of predetermined cross section, the end defining a support surface about the opening and a first lip extending outward from the edge of the support surface of the opening, the air conditioner evaporator having an end with an opening of predetermined cross section larger than the opening through the heater, comprising:

a frame for attachment to the end of the air conditioner evaporator;

a plurality of panels attached to the frame and extending inwardly therefrom, each of said panels having a plurality of side by side segments separated by a frangible connection to permit selected segments to be broken off the panels; and means for attaching the panels within said frame to reduce the size of the opening through the frame and block off a portion of the opening in the air conditioner evaporator, the selected segments being broken off of said panels to increase the size of the opening in the frame to fit the adapter on the support surface of the heater with the lip extending through the opening of the frame thereof.

7. The adapter of claim 6 wherein said means for attaching mounts said panels on the frame for sliding motion toward and away from the lip of said heater.

8. The adapter of claim 6 wherein said frame is rectangular, having sides and ends, said panels including two end panels and two side panels, said attachment means attaching the end panels along the ends of the frame so that the end panels extend inwardly from the frame and attaching the side panels along the sides of the frame overlying the ends panels so that the side panels extend inwardly from the frame.

9. The adapter of claim 6 wherein said frame is rectangular, said means for attaching defining guide surfaces, the panels including two side panels and an end panel for sliding motion along said guides, each of said panels having a lip for abutting said frame when said selected segments have been broken off of the panels to fit the adapter on the support surface of the heater about the lip thereof.

10. The adapter of claim 6 wherein said frame is an integral part of the evaporator.

11. An adapter for joining a heater to an air conditioner evaporator with the air plenums of the heater and evaporator connected, the heater having an end with an opening of predetermined cross section, the end defining a support surface about the opening and a first lip extending outward from the edge of the support surface at the opening, the air conditioner evaporator having an end with an opening of predetermined cross section larger than the opening through the heater, comprising:

a rectangular frame, at least two sides of the frame having a rim, the frame being attached to the end of the evaporator;

at least three panels, each having a plurality of side by side segments separated by a frangible connection to permit selected segments to be broken off a panel; and means for attaching the panels within said frame so that the panels extend from the rim of the frame inwardly to reduce the size of the opening through the frame and block off a portion of the opening in the air conditioner evaporator, selected segments being broken off of the panels to increase the size of the opening in the frame to fit the adapter on the support surface of the heater with the lip thereof extending through the opening of the frame.

12. The adapter of claim 11 wherein all sides of the frame are provided with a rim and four panels are employed extending inwardly from each of the sides of the frame.

13. The adapter of claim 11 wherein the rims of said frame define guides for slidably mounting said panels for movement inward of the frame, each of said panels having a lip for contact with the frame when selected segments have been broken off the panels to fit the adapter on the support surface of the heater.

14. The adapter of claim 11 wherein the evaporator defines a second lip and said frame is provided with a lip for attaching the frame to the evaporator.

15. The adapter of claim 11 wherein the frame is an integral portion of the evaporator.

* * * * *